United States Patent [19]

Rabinovich et al.

[11] 4,145,563

[45] Mar. 20, 1979

[54] PLANT FOR AND METHOD OF ELECTROSLAG REMELTING OF METALS AND ALLOYS

[75] Inventors: Volf I. Rabinovich; Jury N. Kriger, both of Chekhov; Alexandr I. Sapozhnikov; Igor A. Svitenko, both of Moscow; Viktor E. Sapunov, Chekhov; Vyacheslav V. Filippov, Chekhov; Vladimir A. Karpov, Chekhov, all of U.S.S.R.

[73] Assignee: Venjukovsky Armaturny Zavod, Chekhov, U.S.S.R.

[21] Appl. No.: 679,227

[22] Filed: Apr. 22, 1976

[51] Int. Cl.[2] ..... H05B 3/60

[52] U.S. Cl. ..... 13/9 ES

[58] Field of Search ..... 13/9, 9 ES

[56] References Cited

U.S. PATENT DOCUMENTS

| | | | |
|---|---|---|---|
| 2,367,123 | 1/1945 | Hopkins | 13/9 ES |
| 2,406,147 | 8/1946 | Hopkins | 13/33 X |
| 3,565,994 | 2/1971 | Jackson | 13/34 |

*Primary Examiner*—R. N. Envall, Jr.

*Attorney, Agent, or Firm*—Holman & Stern

[57] ABSTRACT

A plant for electroslag remelting of metals and alloys, comprising a cooled mould mounted on a cooled base plate where a slag bath is arranged. Introduced into said slag bath is one end of a consumable electrode, its other end being connected to one of the poles of a current supply source. The plant has at least one non-consumable electrode that is connected to the other pole of the current supply source in series with the consumable electrode. A method of electroslag remelting of metals and alloys in which an electric current is passed through the consumable electrode the slag bath and the non-consumable electrode during the remelting process.

23 Claims, 30 Drawing Figures

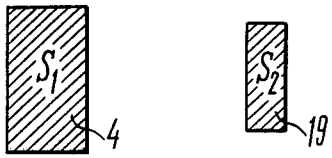
FIG. 8
FIG. 9
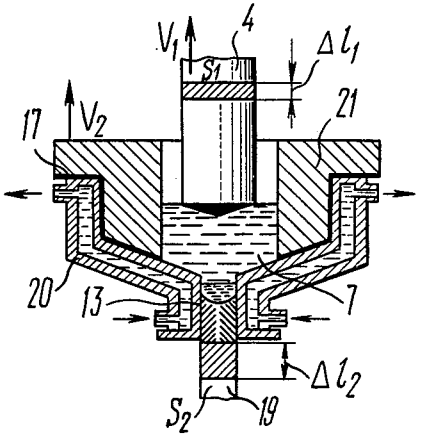
FIG. 10
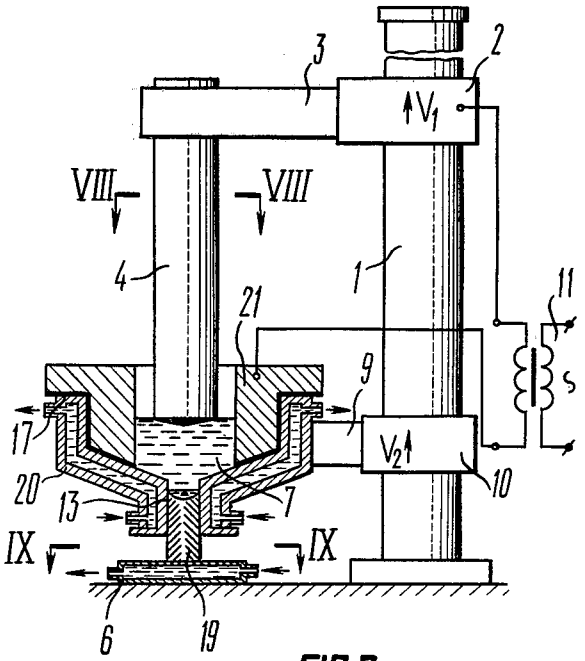
FIG. 7

PLANT FOR AND METHOD OF ELECTROSLAG REMELTING OF METALS AND ALLOYS

BACKGROUND OF THE INVENTION

The present invention relates to plants for and methods of electroslag remelting of metals and alloys. It is particularly useful for producing ingots and slab ingots for subsequent metallurgical conversion and for manufacturing sound shaped castings for machine-building industry, said castings being less expensive and at least equal in terms of quality than welded-and-forged or extruded-and-welded structures.

In many industrially developed countries of the world the engineering and technology of electroslat remelting of metals and alloys are striding vigorously.

This has created a problem of providing such plants and methods which would offer, firstly, a higher efficiency of the installations along with a high quality of metal, secondly, the production of various products such as ingots, slab ingots, shaped castings, tubes, tube skelps, etc., on the same equipment and, thirdly, simplification of both the maintenance and operation of the metallurgical equipment.

At present known in the art is a plant for electroslag remelting of metals in a cooled mould with two consumable electrodes or two groups of consumable electrodes connected in series to an electric circuit. Both consumable electrodes or both groups of consumable electrodes are mounted in a single electrode holder, being carried vertically at the same rate by one common vertical transfer gear. Now said plant is employed for producing slab ingots.

However, the above plant is not free of disadvantages, of which the main one consists of being unable to produce hollow shaped castings with projecting parts, a feature limiting the field of its application. Moreover, said plant fails to avoid considerable heat losses in the slag bath owing to a high cooling rate of the mould in the slag bath zone.

Also known in the art is an installation for electroslag remelting of metals and alloys, comprising an auxiliary electrode for sustaining the requisite temperature of liquid slag and metal in a mould at the instant when a new electrode is fitted upon melting the preceding one.

However, in the above installation said auxiliary electrode operates only during the replacement of the melted consumable electrode, while its application in said installation complicates both the installation design and attendance. Moreover, in view of the interruption in the electroslag remelting process needed to replace the consumable electrode, a rough ingot surface is produced and, in spite of its operation during the replacement period, the auxiliary electrode adversely affects the quality of metal obtained.

Known as well in the art is a method of electroslag remelting of metals and alloys in which an electric current is fed through a consumable electrode and slag to a copper mould. The above method intensifies the melting of the electrode, i.e. provides a higher efficiency of the electroslag remelting process.

However, said method suffers from a serious disadvantage which resides in electrolytic attack on the working surface of the copper mould and its erosion owing to the passage of the electric current from the consumable electrode through the slag to the mould which causes rapid failure of the latter.

Also known in the art is a plant for producing a hollow metal ingot by the electroslag remelting technique, wherein a mound and a mandrel shape said hollow ingot, a power supply source being connected to said mandrel and to a consumable electrode. In service current is passed through the consumable electrode, a slag bath and the mandrel.

A disadvantage of said plant lies in rapid failure of the mandrel owing to electrolytic deterioration and erosion of the mandrel surface caused by the passage of the electric current through the slag and said mandrel.

Known in the art is a method of electroslag remelting of a consumable electrode in a cooled mould by moving both the electrode and the mould during said remelting to provide opposite motion of the electrode and the mould. With said method the cross section of the consumable electrode must be smaller than that of an ingot being melted, the height of the melted ingot being therefore always smaller than the length of the consumable electrode. Sometimes, particularly when producing tube skelps and slab ingots, the casting being melted must have a considerable height. However, the above method fails to provide such castings.

Also known in the art is a plant for producing ingots in metal alloys, especially in steel, by the electroslag remelting technique, said plant comprising a mould whose bottom part determines the external dimensions of an ingot being moulded, said bottom mould part passing into a flaring, preferably, conical intermediate part which in turn passes into a spreading out top part. Both the mould and the ingot move relative to each other. Said plant is superior to the prior-ones in that it is adaptable for remelting electrodes with a cross section greater than that of the ingot being melted.

However, said plant suffers from a low efficiency and fails to produce shaped castings with projecting parts. The flared top part of the mould serves either as a collector of liquid slag and metal or as a bath for melting metal and increases the cooled surface of the mould walls coming in contact with the molten slag during electroslag remelting, which in turn increases heat removal from the slag bath thereby diminishing the plant efficiency.

Known as well is a plant for electroslag melting of shaped castings with concurrent fusing of certain members, said plant comprising a mould mounted on a base plate with an opening, into which a member being fused is introduced, and an electric current switch which connects one of the poles of a power supply source either to the mould or to a consumable electrode.

A disadvantage of said plant resides in that as an electric current passes through the mould and the fused member, power losses are too high owing to buildup of slag accretions on the working surface of the mould; however, the mould walls and the base plate can break down upon spreading of a metal pool and making an electric "mould-fused member" circuit by said metal pool.

SUMMARY OF THE INVENTION

The main object of the present invention is to overcome the above disadvantages peculiar to prior-art plants and methods of electroslag remelting of metals and alloys.

Another object of the invention is to provide a plant for and a method of electroslag remelting of metals and alloys which offer not only a considerably higher efficiency, as compared with the prior-art plants of the type described, but would produce various products of the same plant, i.e. would extend the field of application of the electroslag remelting facilities and simplify concurrently both the maintenance and operation of said plant.

Said and other objects are achieved in a plant for electroslag remelting of metals and alloys, comprising a cooled mould mounted on a base plate and adapted to contain a slag bath, with the bottom end of a consumable electrode being submerged into said slag and said electrode being connected to one of the poles of an electric current supply source and being carried by a vertical transfer gear, and at least one non-consumable electrode connected to the other pole of the electric current supply source in series with the consumable electrode, the non-consumable electrode and the base plate being movable relative to each other in a vertical direction.

The application of said plant accelerates the melting of the consumable electrode with the same power input, in other words, a higher plant efficiency and better quality of an ingot are provided owing to more efficient and complete utilization of heat power of the slag bath. Moreover, this eliminates the necessity for dummy bars which are unavoidable in prior-art plants, thus simplifying the electroslag remelting technique and providing a better design of the base plate.

Relative movement of the non-consumable electrode and the base plate can be effected since the non-consumable electrode is fitted with a vertical transfer gear or the base plate can be provided with a gear for vertical transfer of the ingot being melted. In the latter case the non-consumable electrode and the mould are immovable during the electroslag remelting process which simplifies both the maintenance and operation of the plant.

The non-consumable electrode is preferably hollow, fixed on an internal wall of the mould and insulated electrically therefrom, while the consumable electrode must be arranged inside the non-consumable electrode and immersed with its bottom end in the slag bath; it is expedient that the mould and the non-consumable electrode be carried upwards by one vertical transfer gear, the ingot remaining stationary.

Said plant is well adaptable for effecting the method based on an opposite motion of the consumable electrode and the mould, the plant efficiency being in this case considerably higher than that of prior-art installations owing to a rational electric circuitry employed for connecting both the consumable the non-consumable electrodes to the power supply source and because the hollow non-consumable electrode fed into the slag bath acts at the same time as a heat-insulating element, diminishing heat losses of the slag bath owing to heat transfer to the mould wall, insofar as said wall happens to be heat-insulated by the non-consumable electrode.

The base plate can be equipped with a gear for vertical transfer of the ingot being melted, the mould and the non-consumable electrode being stationary in that case.

Sometimes it is convenient in terms of design to make the non-consumable electrode as current-carrying plates encompassing the consumable electrode, said non-consumable electrode (plates) being mounted on the internal surface of the mould and insulated electrically therefrom.

The current-carrying plates can be set up along the entire perimeter of the internal mould surface.

The non-consumable electrode can be made hollow, a mandrel being fixed therein and insulated electrically therefrom, the consumable electrode in this case encompassing at least partly the non-consumable electrode and being submerged with its bottom end into the slag bath; the non-consumable electrode, the mandrel and the mould are preferably carried upwards by a vertical transfer gear ensuring the production of a hollow casting.

The proposed plant makes it possible to produce tube skelps by electroslat remelting of melts and alloys, heat losses of the slag bath owing to heat transfer to the mandrel diminishing in this case as the mandrel happens to be heat-insulated by the non-consumable electrode.

The base plate can be fitted with a vertical transfer gear for carrying the melted tube skelp.

To produce a hollow casting with a bottom, the plant for electroslag remelting of metals and alloys, is fitted with a current switch connected from one side to one of the poles of the current supply source and from the other side to the base plate or to the non-consumable electrode.

Such an embodiment makes it possible at the initial moment, when melting the bottom of a preset thickness, to operate on the proposed plant according to a conventional circuit passing an electric current through the consumable electrode, the slag bath, the ingot and the base plate.

It is sound practice, when producing tube skelps on the plant for electroslag remelting of metals and alloys, that the non-consumable electrode be made as two hollow rods of any desirable cross section, concentric with each other, one of said rods accommodating a mandrel electrically insulated therefreom and the other rod beind disposed on the internal surface of the mould and being electrically insulated therefrom, the consumable electrode that is made hollow being advisable to be set up intermediate of the hollow rods, concentric therewith and submerged with its bottom end into the slag bath, the non-consumable eletrode and the mould being carried upwards by one vertical transfer gear relative to the melted tube skelp.

Such a plant enables the production of diversified hollow casting with low heat losses of the slag bath owing to the non-consumable electrode thermally insulating said slag bath from both the cooled mould walls and the mandrel, a feature which enhances the plant efficiency.

On said plant the base plate can be equipped with a gear for vertical transfer of the melted tube skelp.

In case a plant for electroslag remelting of metals and alloys is furnished with a base plate having an opening wherein a member, being fused, is fed and with a current switch connected from one side to one of the poles of the current supply source and from the other side to the fused member or the consumable electrode, said plant is adapted for producing shaped castings by the electroslag remelting technique with concurrennt fusing of certain parts, ensuring a guaranteed quality of joining the member being fused with a casting body.

The above plant provided with the current switch connected from one side to one of the poles of the current supply source and from the other side to the consumable electrode or the base plate enable the consumable electrodes to be replaced in the course of electroslag remelting, providing sound castings.

It is expedient that in said plant for electroslag remelting of metals and alloys the non-consumable electrode be made of graphite.

Graphite is a good conductor of electricity, it features a high heat resistance and owing to its great affinity to oxygen it is a good deoxidizer during electroslag remelting, this being especially important when remelting steels containing such easily oxidizable elements as titanium, silicon, aluminum, etc.

The method of electroslag remelting of metals and alloys on the proposed plant, according to the invention, consists in that during the entire electroslag remelting process an electric currennt is passed through a consumable electrode, the slat bath and the non-consumable electrode.

It is good practice if during the entire electroslag remelting process the non-consumable electrode is carried upwards by the vertical transfer gear at a rate equal to that of motion of the slag bath, thereby keeping the end of the non-consumable electrode submerged in the slag bath, with the consumable electrode being carried downwards, as it melts, to obtain an ingot of remelted metal.

In case the plant for electroslag remelting of metals and alloys comprises a vertical transfer gear for the base plate, the ingot set up on said base plate is carried downwards, as it is being built up, so that the level of said slag bath remains constant relative to the stationary non-consumable electrode and mould.

If the plant for electroslag remelting of metals and alloys employs a hollow non-consumable electrode fixed on the internal surface of a mould, said non-consumable electrode is carried upwards together with the mould by one vertical transfer gear with repsect to the ingot being melted, thereby realizing an electroslag remelting method with an opposite motion of the mould and the consumable electrode.

In case the plant is fitted with a gear for vertical transfer of the base plate, the ingot being melted is carried downwards by said vertical transfer gear, the non-consumable electrode and the mould being immovable in this case.

According to the invention, to produce a tube skelp on said plant for electroslag remelting of metals and alloys, the non-consumable electrode is carried upwards by the vertical transfer gear together with the mandrel, the tube skelp being immovable.

When moulding a tube skelp on a plant provided with a vertical transfer gear for the base plate, said tube skelp is carried downwards, the non-consumable electrode, the mandrel and the mould being stationary so that the level of the slag bath is kept constant ensuring the shaping of the tube skelp.

For producing an ingot of remelted metal with a greater length than that of the melted electrode, the consumable electrode, the electrode and the mould are transferred upwards, the consumable electrode being carried at a rate of 0.05–0.95 the rate of motion of the slag bath, while the non-consumable electrode and the mould travel at the rate of transfer of said slag bath, maintaining the ends of both the consumable and the non-consumable electrodes immersed in the slag bath.

From the equality of volumes of remelted electrode metal and that obtainable upon remelting it follows that the height of the melted ingot will be much greater than the length of the consumable electrode, as the cross section of said consumable electrode is greater than that of the melted ingot, i.e., $l_2:l_1 = S_1:S_2$, where $l_2$ and $l_1$ are the lengths accordingly of the ingot being melted and the consumable electrode, and $S_2$ and $S_1$ being their cross sections.

By selecting the ratio $S_2:S_1$ within (0.95–0.05) the rate of transfer of the consumable electrode, i.e., the electrode melting rate will vary within (0.05–0.95) of the slag bath transfer, i.e., of the ingot build-up rate.

Thus, by choosing consumable electrodes of appropriate cross sections and lengths it is possible to obtain the melted ingot of a maximum height. Moreover, the use of low-height electrodes with large cross sections decreases power consumption owing to a lower electric resistance of the consumable electrode.

If the plant is provided with a gear for vertical transfer of the base plate, then, said gear carries an ingot downwards so that the level of the slag bath is kept constant relative to the stationary non-consumable electrode and mould, with the consumable electrode being carried downwards, as it melts.

To enable the production of ingots of a still greater height, from the beginning of the remelting process the ingot is carried downwards by the vertical transfer gear to an extent of possible gear transfer so that the level of the slag bath is constant with respect to the immovable non-consumable electrode and mould. The consumable electrode of a cross section ($S_1$) greater than that ($S_2$) of the melted ingot being carried downwards, as said consumable electrode melts, whereupon the gear discontinues the ingot transfer and up to the end of the remelting process the consumable electrode, the non-consumable electrode and the mould are carried upwards, the consumable electrode being moved at a rate of 0.05–0.95 the rate of the slag bath, while the non-consumable electrode and the mould travel at the rate of transfer of the slag bath, keeping the ends of both the consumable and the non-consumable electrodes submerged in the slag bath and ensuring the production of the ingot superior in height to a plant mast.

To produce a tube skelp with a wall thickness smaller than the cross section of the remelted electrode, the consumable and non-consumable electrodes, the mould and the mandrel are carried upwards, the consumable electrode being transferred at a rate of 0.05–0.95 the rate of the slag bath, while the non-consumable electrode, the mould and the mandrel are shifted at the rate of the slag bath, with the ends of both the consumable and non-consumable electrodes being immersed in said slag bath.

In case the plant comprises a gear for vertical transfer of the base plate, then, said gear is employed for carrying the tube skelp downwards so that the level of the slag bath remains constant relative to the immovable non-consumable electrode, mould and mandrel, the consumable electrode with a cross-sectional area ($S_1$) greater than that ($S_2$) of the melted tube skelp being carried downwards, as said consumable electrode melts, keeping the ends of both the consumable and non-consumable electrodes immersed in the slag bath and ensuring the production of the tube skelp with the wall smaller in thickness than the cross-section of the remelted electrode.

To enable the manufacture of a tube skelp superior in height to the plant mast, from the beginning of the remelting process the vertical transfer gear carries the tube skelp being melted downwards so that the level of the slag bath is kept constant relative to the immovable non-consumable electrode, mould and mandrel, with said consumable electrode having a cross-sectional area ($S_1$) greater than that ($S_2$) of the melted tube skelp being transferred downwards, as said electrode melts, whereupon further transfer of the tube skelp is discontinued, the consumable electrode being transferred up to the end of the process at a rate of 0.05–0.95 the rate of the slag bath, while the non-consumable electrode, the mould and the mandrel are shifted at the rate of the slag bath, with the ends of both the consumable and non-consumable electrodes being immersed in said slag bath.

When producing hollow shaped castings with a bottom by the method of the invention the consumable electrode at first is remelted by passing an electric current through said electrode, the slag bath and the base plate with the non-consumable electrode, the mandrel and the mould being immovable until the bottom of a given thickness is built-up and until the end of the consumable electrode submerges in the slag bath, whereupon and up to the end of the process the current is passed through the consumable electrode, the slag bath and the non-consumable electrode, the mandrel and the non-consumable electrode being carried upwards at a rate equal to that of the slag bath, sustaining the end of the non-consumable electrode in said slag bath and moulding the interior of the casting being melted.

For producing hollow castings by using a movable mould, upon moulding the bottom of a given thickness, both the mandrel and the non-consumable electrode are transferred together with the mould by one vertical transfer gear.

If the plant is fitted with a gear for vertical transfer of the base plate, then upon moulding the bottom, the hollow casting is carried downwards by said vertical transfer gear relative to the immovable mandrel, non-consumable electrode and mould.

It is expedient that during electroslag remelting of metals and alloys, upon melting of one consumable electrode the current supply source be disconnected from the consumable electrode and connected to the base plate to maintain the slag in a hot fluid state, whereupon the melted consumable electrode is replaced, with the end of a new consumable electrode being submerged in the slag bath, said consumable electrode is again connected to the current supply source and electroslag remelting of said new consumable electrode continues.

Thus, a plurality of low-height consumable electrodes can be remelted one after another into heavy ingots. This is convenient and profitable for the manufacturing of consumable electrodes and enables the arrangement of an electroslag remelting plant in premises of a limited height, this being of prime importance when organizing a new production.

In electroslag remelting of metals and alloys it is sound practice, upon establishing the slag bath to pass the electric current through the non-consumable electrode, the slag bath and a fused member until the top end face of said fused member starts melting, with the consumable electrode being withdrawn from the slag bath to be thereupon submerged with its end in said slag bath, following which the electric current is passed through the consumable electrode, the slag bath and the non-consumable electrode until the completion of the electroslag remelting process, ensuring a guaranteed jointing of the fused member to a casting body.

BRIEF DESCRIPTION OF THE DRAWINGS

The nature of the invention will be clear from the following detailed description of particular embodiments of a plant for and a method of electroslag remelting of metals and alloys to be considered in conjunction with the accompanying drawings, in which:

FIG. 7 depicts a plant with a mould flaring in its top portion and an insertion piece shaped as a non-consumable electrode;

FIG. 8 is a sectional view taken along line VIII—VIII of FIG. 7;

FIG. 9 is a sectional view taken along line IX—IX of FIG. 7;

FIG. 10 illustrates the calculation of the rate of transfer of a consumable electrode;

DETAILED DESCRIPTION OF THE PREFERRED EMBODIMENTS

Considered hereinbelow are several examples illustrating the application of the present invention while:

(a) producing ingots;

(b) producing tube skelps;

(c) producing hollow castings with a bottom;

(d) replacing consumable electrodes during melting; and (e) producing castings with concurrent fusing of certain members.

Figure 1:
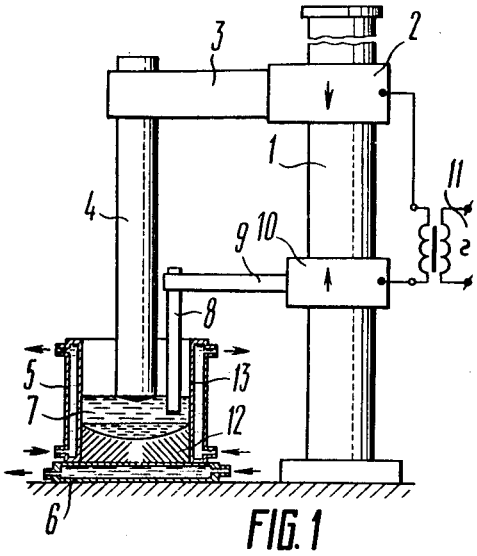
FIG. 1 shows a plant for electroslag remelting of metals and alloys.

A plant for electroslag remelting of metals and alloys comprises a bearing mast 1 (FIG. 1) and a top carriage 2 travelling there along said carriage 2 mounting an electrode holder 3 with a consumable electrode 4 fixed therein. To shape an external surface of ingots use is made of a cooled mould 5 set up on a cooled base plate 6. Prior to the beginning of the electroslag remelting process a slag bath 7 is established in the mould 5 (molten slag starting), the consumable electrode 4 and a non-consumable electrode 8 being submerged in said slag bath 7. The non-consumable electrode 8 is secured by means of a stand 9 to a bottom carriage 10 mounted on the mast 1 and adapted for vertical transfer of said non-consumable electrode 8 along the mast 1. Both the consumable electrode 4 and the non-consumable electrode 8 are connected to different poles of an a.c. supply source 11, an electric current thereby passing through the consumable electrode 4, the slag bath 7 and the non-consumable electrode 8. To enable the ends of the consumable electrode 4 and the non-consumable electrode 8 to be always immersed in the slag bath 7 during the entire electroslag remelting process, the non-consumable electrode 8 is transferred upwards at a rate equal to that of the slag bath 7, while the consumable electrode 4 is lowered into said slag bath 7, as it melts.

An ingot 12 being melted is shaped by the base plate 6 and the mould 5. To preclude the passage of the electric current to an internal wall 13 of the mould 5 neither the consumable electrode 4 nor the non-consumable electrode 8 is electrically associated with the mould 5, said mould 5 together with the base plate 6 not being connected into the electric circuit. Insofar as the mould 5 and the base plate 6 are dead, their walls are therefore protected against electrochemical attack.

Figure 2:
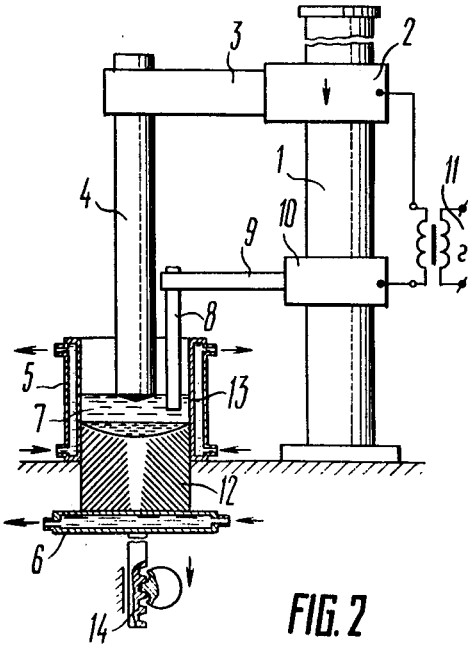
FIG. 2 depicts a plant for electroslag remelting of metals and alloys with an ingot vertical transfer gear.

In case the plant base plate 6 (FIG. 2) is fitted with a gear 14 for vertical transfer of the ingot 12, there is no need to transfer the non-consumable electrode 8. In this case the vertical transfer gear 14 carries the ingot 12 downwards, as it is built up, so that the level of the slag bath 7 is kept constant with respect to the immovable non-consumable electrode 8 and mould 5.

Said plant is more convenient in service because the mould is stationary during the melting process, however, it requires a vertical shaft for its arrangement with a depth sufficient to accommodate the melted ingot 12.

Figure 3:
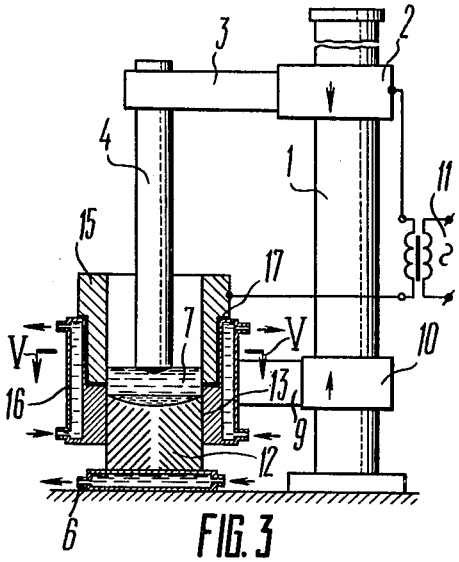
FIG. 3 represents a plant for electroslag remelting of metals and alloys with a non-consumable electrode set up on an internal surface of a mould.

FIG. 3 shows a plant for electroslag remelting of metals and alloys in which a non-consumable electrode 15 is made hollow and is rigidly fixed on the internal wall 13 of a mould 16 having a low height at compared with the above plant. To preclude the passage of an electric current to the mould 16, a layer 17 of electric insulation is placed between the non-consumable electrode 15 and the mould 16.

Owing to said design the low-height mould 16 can be used for producing ingots 12 of considerable height because both the mould 16 and the non-consumable electrode 15 are carried upwards by a vertical transfer gear (bottom carriage) 10.

In operation the non-consumable electrode 15 is carried upwards together with the mould 6 by the vertical transfer gear 10 relative to the melted ingot 12.

Figure 4:
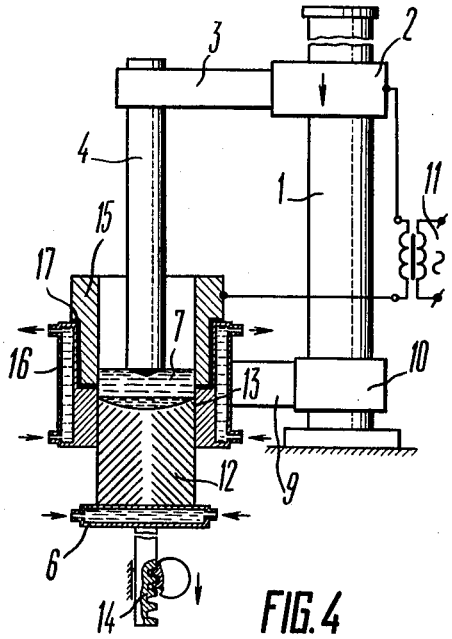
FIG. 4 shows the same plant, as shown in FIG. 3, with an ingot vertical transfer gear.

If the base plate 6 of the plant (FIG. 4) is equipped with the gear 14 for vertical transfer of the ingot 12, the melted ingot 12 is carried downwards by said vertical transfer gear 14 with the non-consumable electrode 15 and the mould 16 being stationary.

Figure 5:
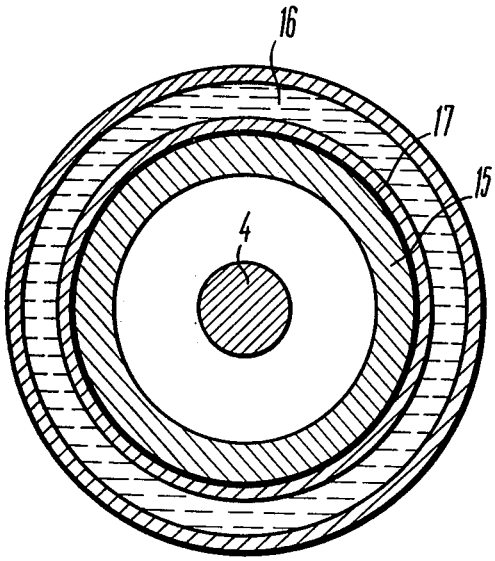
FIG. 5 - section is a sectional view taken along line V—V of FIG. 3.

Shown in FIG. 5 is a cross-sectional view of the non-consumable electrode 15 which is made as a hollow rod.

Figure 6:
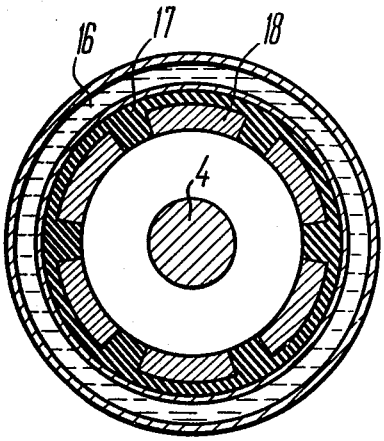
FIG. 6 shows a sectional view similar to FIG. 5 with another possible embodiment of the non-consumable electrode.

However, sometimes in terms of design it is more convenient to employ a non-consumable electrode made as plates 18 (FIG. 6) encompassing partly or completely the consumable electrode 4, said plates 18 being mounted on the internal surface 13 of the mould 16 and electrically insulated therefrom.

FIG. 7 shows the functioning of a plant for electroslag remelting of steel and alloys when producing a slab ingot 19. A mould 20 of said plant flares in its top portion to accommodate the slag bath 7 in which the consumable electrode 4 melts. A non-consumable electrode 21 is an insertion piece arranged on the flared top portion of the mould 20. The slab ingot 19 is being shaped in the bottom narrowing part of the mould 20.

Said design of the plant allows, firstly, remelting the electrode 4 with a cross section $S_1$ (FIG. 8) greater than the cross section $S_2$ (FIG. 9) of the melted ingot 19, creating, secondly, more favorable conditions for fusing of the consumable electrode 4 and shaping of the slab ingot 19, a feature which renders the plant more compact and efficient.

By melting the consumable electrode 4 with a cross section $S_1$ greater than the cross section $S_2$ of the melted slab ingot 19, with the consumable electrode 4, the non-consumable electrode 21 and the mould 20 being carried upwards, ingots of a large height can be produced.

Said examples are considered hereinafter in detail.

If the electroslag remelting process is conducted with a constant rate, uniformly, and the volume of the slag bath 7 constant, the rate of transfer of the consumable electrode 4 (FIG. 10) will be:

$$V_1 = \frac{\Delta l_2 - \Delta l_1}{\Delta t} \quad (1)$$

where $V_1$ is the rate of transfer of the consumable electrode 4;

$\Delta l_1$ is the length of a fused part of the consumable electrode 4;

$\Delta l_2$ is the height of a built-up part of the slab ingot 19; and $\Delta t$ is a time interval under consideration.

The built-up rate ($V_2$) of the slab ingot 19 or the rate with which the slag bath 7, the mould 20 and the non-consumable electrode 21 move will become equal accordingly:

$$V_2 = \frac{\Delta l_2}{\Delta t} \quad (2)$$

From the equations (1) and (2) it can be found:

$$\frac{V_1}{V_2} = 1 - \frac{\Delta l_1}{\Delta l_2} \quad (3)$$

From the equality of volumes of remelted metal of the consumable electrode and that of the obtained slab ingot 19:

$$S_1 \cdot \Delta l_1 = S_2 \cdot \Delta l_2 \quad (4)$$

or $$\frac{\Delta l_1}{\Delta l_2} = \frac{S_2}{S_1} \quad (5)$$

Substituting (5) into (3)

$$V_1 = V_2(1 - \frac{S_2}{S_1}) \quad (6)$$

Substituting practical limits of $S_2/S_1 = 0.95$–$0.05$ in equation (6), it is possible to find out the rate ($V_1$) of transfer of the consumable electrode 4 which amounts to 0.05–0.95 the rate ($V_2$) of travel of the slag bath 7.

The foregoing is illustrated below by an example.

The cross section $S_1$ of the consumable electrode 4 is twice as great as the cross section $S_2$ of the slab ingot 19 being melted. Then by mounting the consumable electrode 4 in the middle of the mast 1, its remelting in the slag bath 7 is initiated. In this case the built-up rate ($V_2$) of the slab ingot 19 will be twice as great as the rate of fusing ($V_1$) of the electrode 4, according to equation (6), both rates being directed upwards. The non-consumable electrode 21 and the mould 20 are carried upwards at the rate of travel of said slag bath 7 by virtue of which the ends of the consumable electrode 4 and the non-consumable electrode 21 are immersed in said slag bath 7.

In the above example as the electrode remelting process comes to an end, the electrode 4 will reach the top end of mast 1, in other words, it will pass a the distance equal to one half of the height of the mast 1. At the same time the height increment of the slab ingot 19 will be twice as great as said distance passed by the electrode 4, i.e., the height of the slab ingot 19 will be equal to that of the mast 1.

Naturally, the electrodes and the ingots may differ in shape.

The present invention may prove to be most advantageous in producing slab ingots. In this case owing to a large ingot height a casting (a slab ingot) can approach to a maximum extent a rolled sheet, diminishing thereby the requisite reduction degree and cutting down the rolling cycle. Moreover, the use of a low-height consumable electrode 4 of a large cross section, as well as the fact that the remelting process is conducted in the slag bath 7 heat-insulated from the cooled walls of the mould 20 by an insertion piece shaped as a non-consumable electrode 21, offers an abrupt decrease in electric energy consumption, i.e., enhances the plant efficiency.

All the foregoing cuts down both the cost of metallurgical production and metal conversion expenditures.

Figure 11:
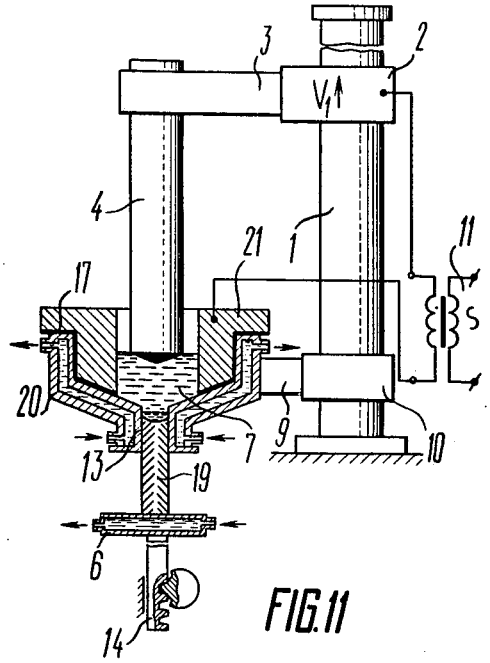
FIG. 11 illustrates the operation of the plant, as shown in FIG. 7 and fitted with an ingot vertical transfer gear.

FIG. 11 shows the production of the slab ingot 19 on a plant with the base plate 6 being fitted with the gear 14 for vertical transfer of said slab ingot 19. During electroslag remelting on said plant the slab ingot 19 is carried downwards by the vertical transfer gear 14 so that the level of the slag bath 7 remains constant relative to the immovable non-consumable electrode 21 and mould 20, the consumable electrode 4 being carried downwards, as it melts.

Said method of electroslag remelting in combination with the above-outlined procedure (with the consumable electrode being shifted upwards) makes it possible to melt slab ingots 19 of a height equal to the sum of distances passed by the gears 10 and 14, i.e., practically the slab ingot 19 can exceed in height that of the mast 1 for a value of possible descend of the base plate 6.

Owing to such large dimensions the slab ingot 19 can be employed as a plate even without rolling, meeting the requirements as to its quality. The present invention is of particular advantage in ship-building when manufacturing ships' hulls. Economic expediency of this application is quite obvious.

Considered hereinbelow is the production of tube skelps.

Figure 12:
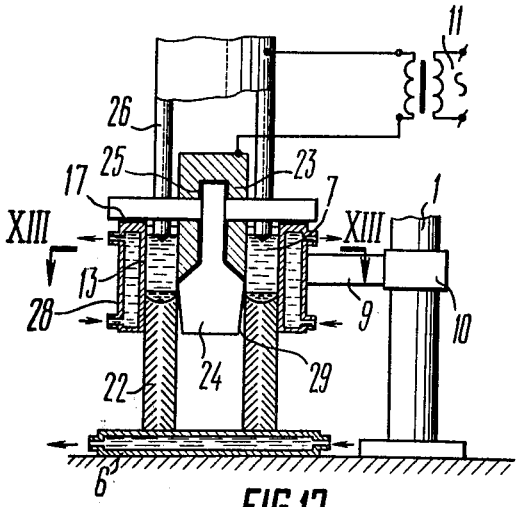
FIG. 12 shows a plant for electroslag remelting of metals and alloys while producing a tube skelp, said plant being provided with a non-consumable electrode and a mandrel introduced therein.

FIG. 12 shows one of the embodiments of a plant for electroslag remelting of metals and alloys for producing a tube skelp 22. On said plant a non-consumable electrode 23 is made hollow to accommodate a mandrel 24 fixed therein. Placed between the non-consumable electrode 23 and an external surface of the mandrel 24 is a layer of electric insulation 25 precluding the passage of an electric current through the mandrel 24. A consumable electrode 26 is made as a tube or of separate rolled bars and encompasses at least partly the non-consumable electrode 23.

Figure 13:
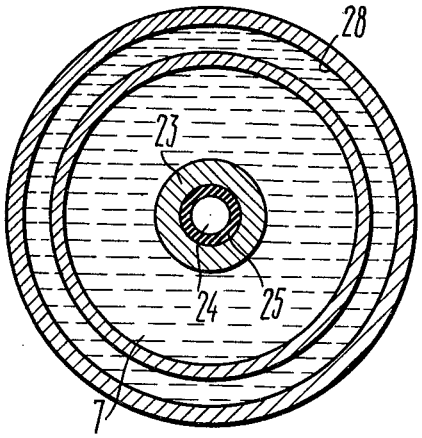
FIG. 13 is a sectional view taken along line XIII—XIII of FIG. 12.
Figure 14:
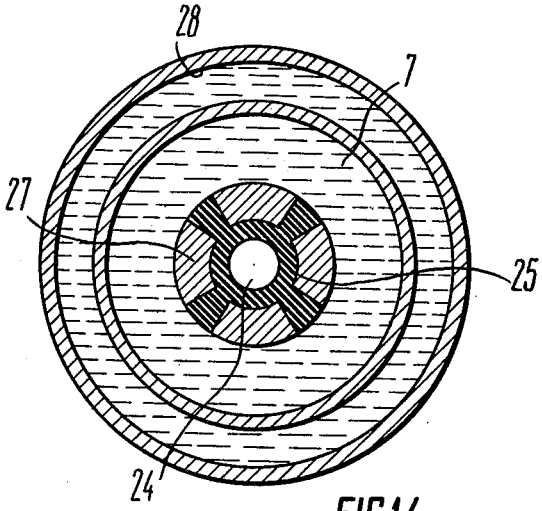
FIG. 14 shows a sectional view similar to FIG. 13 with another possible embodiment of the non-consumable electrode.

The non-consumable electrode 23 may constitute a hollow cylinder 23 (FIG. 13) or it can be made as separate plates 27 (FIG. 14) arranged around the mandrel 24 and encompassing it partly or completely.

The plant functions in the following manner.

Upon mounting a low-height mould 28 on the base plate 6 (FIG. 12), with the mandrel 24 being fixed on the upper part of said mould 28, said mandrel being fitted with the hollow non-consumable electrode 23, a molten slag start is provided by pouring preliminarily heated slag in the mould 28 reaching such a level that the end of the non-consumable electrode 23 happens to be submerged thereinto. Following that the consumable electrode 26 is immersed in said slag bath 7 and by passing an electric current fromthe a.c. supply source 11 through the consumable electrode 26, the slag bath 7 and the non-consumable electrode 23 the electroslag remelting process is initiated.

As the metal of the consumable electrode 26 starts melting, the gear 10 carries the non-consumable electrode 23 together with the mandrel 24 and the mould 28, the tube skelp 22 remaining immovable. The moving internal surface 13 of the mould 28 shapes an external surface of the tube skelp 22, while an external surface 29 of the mandrel 24, on being transferred upwards, shapes the internal surface of the tube skelp 22.

The inherent design of the mandrel 24 with the hollow non-consumable electrode 23 fixed on its upper portion is favorable in that it reduces heat losses of the slag bath 7, provides better conditions for melting the consumable electrode 26 by ensuring better current distribution in the slag bath and precludes electric erosion of the mandrel 24.

Figure 15:
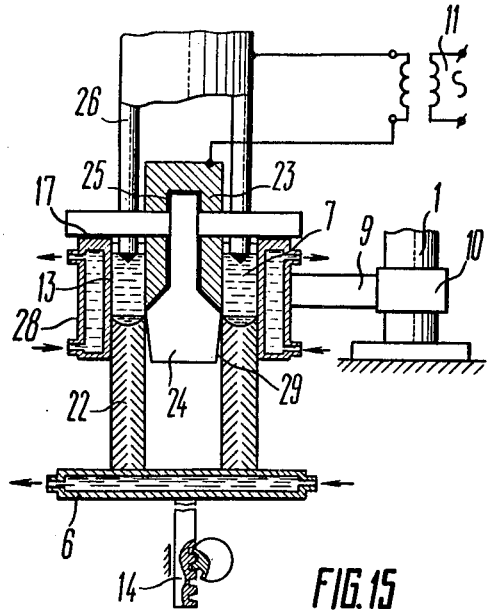
FIG. 15 illustrates the operation of the plant for electroslag remelting of metals and alloys, as shown in FIG. 12, with a tube skelp vertical transfer gear.

FIG. 15 illustrates the operation of a plant for electroslag remelting when producing the tube skelp 22 by using the vertical transfer gear 14. In this case the tube skelp 22 is carried downwards by the vertical transfer gear 14, the consumable electrode 23, the mandrel 24 and the mould 28 being stationary so that the level of the slag bath 7 remains constant.

Said plant provides better servicing conditions.

Figure 16:
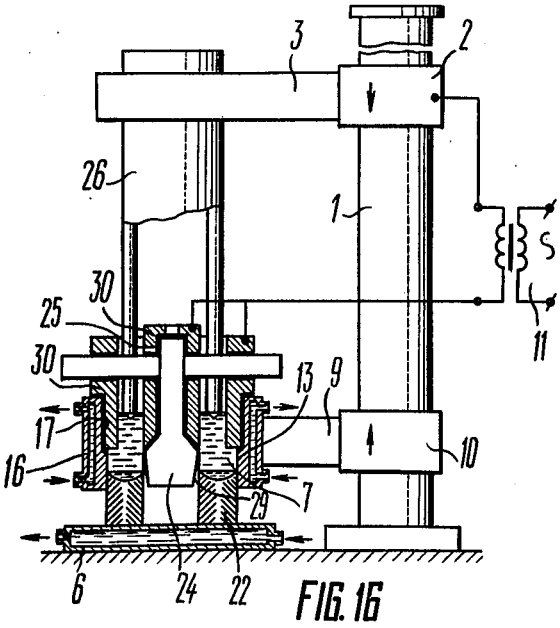
FIG. 16 depicts a plant for electroslag remelting of metals and alloys while producing a tube skelp by using a non-consumable electrode set up on a mandrel and a mould.

FIG. 16 illustrates the operation of a plant when producing the tube skelp 22 with a non-consumable electrode 30 made as two hollow cylinders of any desired cross section, of which one is fixed on the internal surface 13 of the mould 16 and the other one on the mandrel 24.

Said design of the non-consumable electrode creates optimum conditions for current distribution in the slag bath 7 around the consumable electrode 26, ensuring its melting. Moreover, in this case the non-consumable electrode 30 acts as a heat insulator of the cooled walls of the mould 16 and the mandrel 24 in the zone of the slag bath 7, a feature which materially diminishes heat losses in the slag bath 7. Everything taken together enhances the plant efficiency, i.e., decreases the specific consumption of electric power as compared with prior-art installations for electroslag remelting of metals and alloys.

The tube skelp is shaped similarly to the above-outlined procedure, i.e., with the tube skelp 22 being stationary and with the gear 10 moving upwards the mould 16 together with the mandrel 24 the and non-consumable electrode 30.

Figure 17:
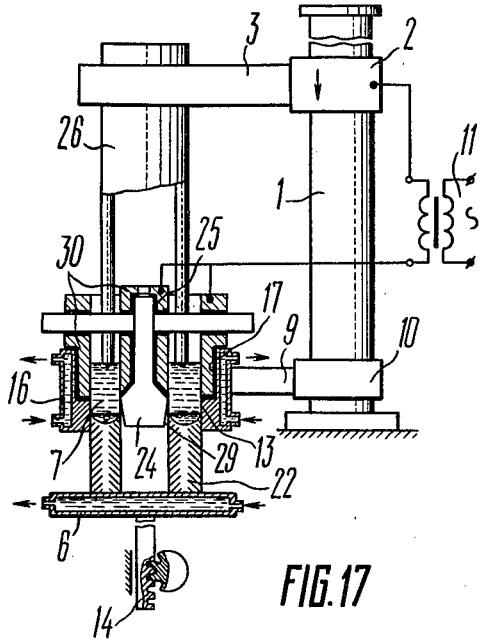
FIG. 17 illustrates the operation of the plant shown in FIG. 16 and fitted with a tube skelp vertical transfer gear.

In another embodiment the mould 16 (FIG. 17), the mandrel 24 and non-consumable electrode 30 are immovable and the tube skelp 22 mounted on the base plate 6 is carried downwards by the gear 14.

This creates better conditions for plant servicing, insofar as the mould 16, the mandrel 24 and the non-consumable electrode 30 are stationary and can be easily observed during the entire process.

Figure 18:
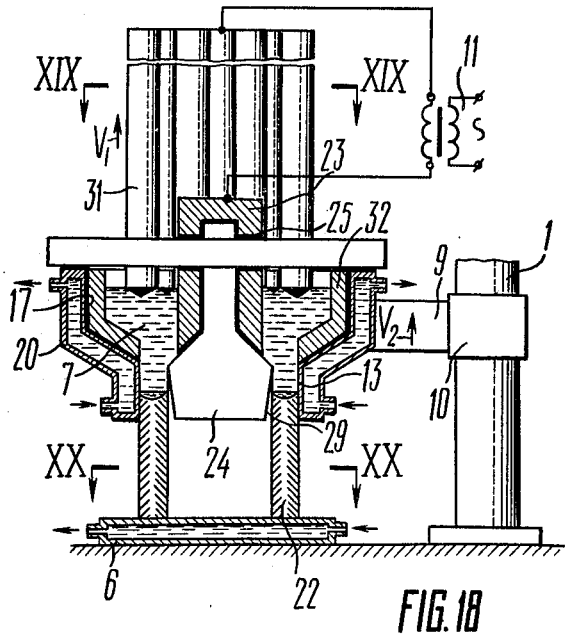
FIG. 18 shows a part of the plant illustrating its functioning with a mould flaring and a mandrel narrowing in their top portions.

FIG. 18 illustrates the operation of a plant when producing the tube skelps 22 with a wall thickness smaller than the cross section of consumable electrodes 31.

Figure 19:
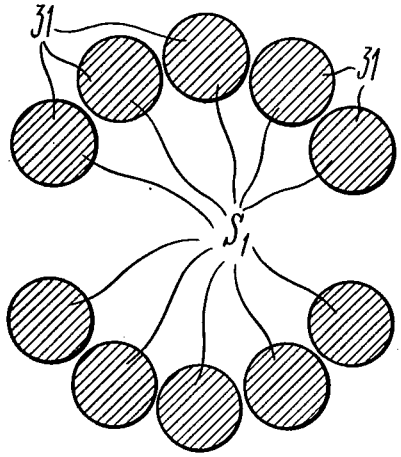
FIG. 19 is a sectional view taken along line XIX—XIX of FIG. 18.
Figure 20:
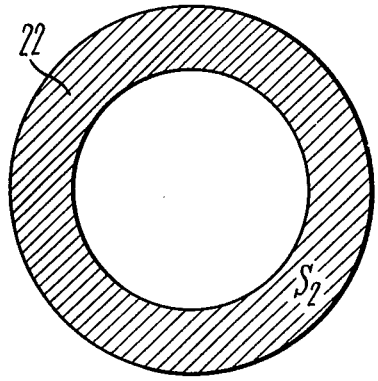
FIG. 20 is a sectional view taken along line XX—XX of FIG. 18.

Fixed on the mould 20 with the flared top portion is a hollow non-consumable electrode 32 electrically insulated by the layer 17 of electric insulation from the walls of the mould 20. Arranged on the top part of the mandrel 24, narrowing towards its top portion, is the hollow non-consumable electrode 23 insulated through the layer 25 of electric insulation from the walls of the mandrel 24. The consumable electrodes 31 made up of individual bars with a total cross-sectional area of $S_1$ (FIG. 19) greater than the sectional area $S_2$ (FIG. 20) of the tube skelp 22 being melted are remelted in the flared portion between the non-consumable electrodes 32 and 23.

The tube skelp 22 (FIG. 18) is shaped similarly to the above-described procedure of producing a slab ingot, i.e., by carrying the consumable electrodes 31, the mould 20 and the non-consumable electrodes 23 and 32 upwards.

Both non-consumable electrodes 23 and 32 and the mould 20 are transferred at a rate $V_2$ that is equal to that of the slag bath 7 which corresponds to the built-up rate of the tube skelp 22. The consumable electrodes 31 are carried upwards at a rate of 0.05–0.95 the rate of the slag bath 7 depending on the ratio of cross-sectional areas of the consumable electrodes 31 ($S_1$) and the tube skelp 22 ($S_2$) being obtained.

Thus, it is possible to produce high thin-walled tube skelp 22. The invention is particularly efficient economically when producing tubes in hard-to-work and non-deformable steels. At present such tubes are usually produced by forging and drilling.

Figure 21:
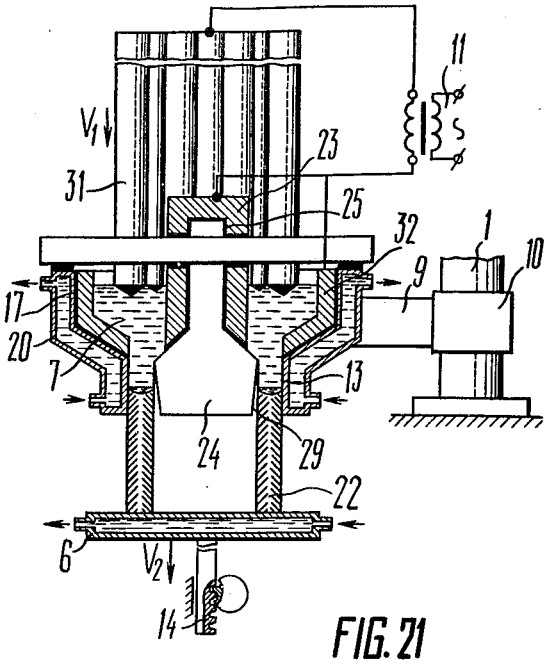
FIG. 21 illustrates operation of the plant, as shown in FIG. 18, provided with a tube skelp vertical transfer gear.

FIG. 21 shows the operation of a plant provided with the gear 14 for vertical transfer of the base plate 6. With the help of said gear 14 the tube skelp 22 is lowered, as it is built-up, so that the level of the slag bath 7 remains constant with respect to the stationary non-consumable electrodes 23 and 32 and mould 20, the consumable electrodes 31 being carried downwards, as they melt.

As the tube skelp 22 is carried downwards, its attendance becomes more convenient, since the mould 20, the non-consumable electrodes 23 and 32 and the slag bath 7 are immovable during the entire process simplifying supervision and carrying out of the requisite production operations.

Moreover, the downward motion of the tube skelp 22 and the consumable electrodes 31, with he mould 20 and the non-consumable electrodes 23 and 32 being stationary, and in combination with an upward motion of the consumable electrodes 31, the mould 20 and the non-consumable electrodes 23 and 32 enables the production of still longer tube skelps 22.

The latter is of prime importance when producing tubes, since it is quite evident that the larger the length of a tube being produced, the smaller is the amount of assembly welds, this being profitable for a tube consumer, renders the manufactured products more competitive by cutting down the production cost, as compared with the tube-making procedures in current use, and ensures high quality of material.

Considered hereinafter is the fabrication of hollow castings with a bottom in their lower portion.

Figure 22:
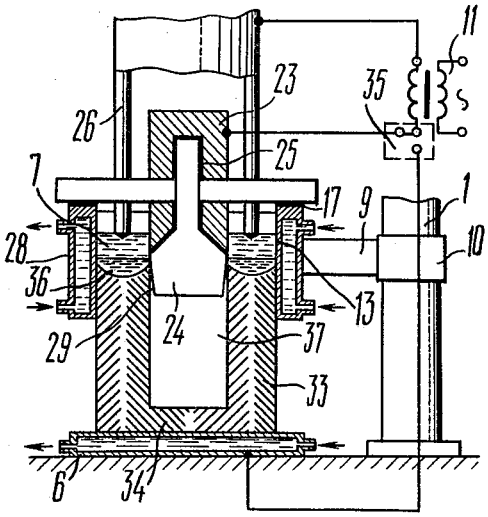
FIG. 22 depicts a plant for electroslag remelting of metals and alloys while producing a hollow casting with a bottom in its lower portion, said plant having a movable external mould.

FIG. 22 illustrates the production of a hollow casting 33 with a bottom 34 in its lower portion.

Upon establishing the slag bath 7 an electric current is passed by means of a switch 35 through the consumable electrode 26, the slag bath 7 and the base plate 6, with the non-consumable electrode 23, the mandrel 24 and the mould 28 being stationary. Under the effect of the electric current the end of the consumable electrode 26 melts, metal droplets collecting in the bottom part of the mould 28 and solidifying on the base plate 6 to form the bottom 34. Gradually both the slag bath 7 and a metal pool 36 climb upwards along the gene-ratrix of the mandrel 24. Upon coming in contact with the surface of the cooled mandrel 24 liquid metal of the metal pool 36 solidifies forming walls of the interior 37, while the slag bath 7 reaches the end of the non-consumable electrode 23. As soon as the end of the non-consumable electrode 23 is immersed in the slag bath 7, the switch 35 disconnects the pole of the current supply source 11 from the base plate 6 and connects it to the non-consumable electrode 23. After the electric current is passed through the consumable electrode 26, the slag bath 7 and the non-consumable electrode 23. At the same time the mandrel 24 with the non-consumable electrode 23 and the mould 28 are carried upwards and up to the end of the process the remaining portion of the hollow casting is moulded similarly to the above-outlined procedure used when producing the tube skelp.

Figure 23:
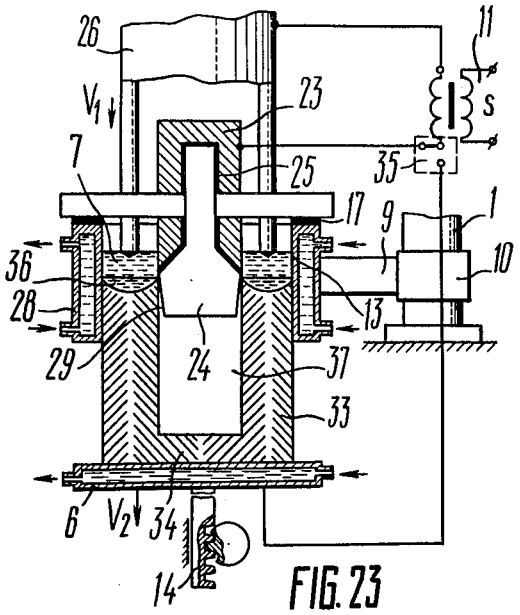
FIG. 23 shows a plant for electroslag remelting of metals and alloys while producing a hollow casting with a bottom in its lower portion, said plant having a base plant transfer gear.

Shown in FIG. 23 is an embodiment illustrating the production of the same hollow casting by using the vertical transfer gear 14.

With the plant operating in the above manner upon shaping the bottom 34, the hollow casting 33 is carried downwards, the mandrel 24, the non-consumable electrode 23 and the mould 28 being stationary. Said method is particularly efficient economically for producing various high-pressure vessels such as: pump bodies, hydraulic (oil) plants and compressor bodies.

Figure 24:
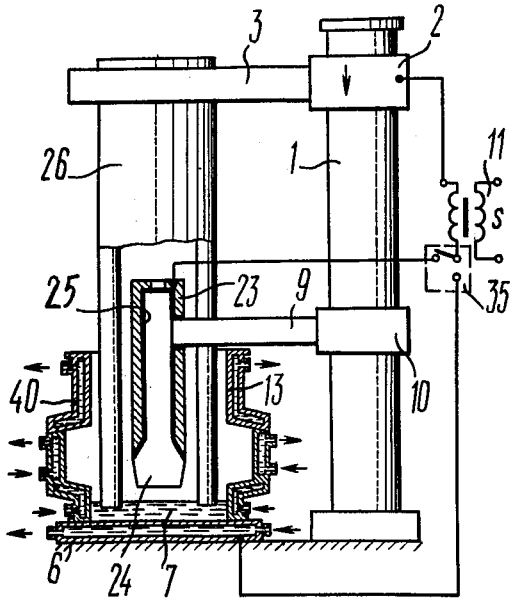
FIG. 24 shows relative position of the parts of a plant for electroslag remelting of metals and alloys at the beginning of the process of producing a hollow shaped casting with a bottom in its lower portion.
Figure 25:
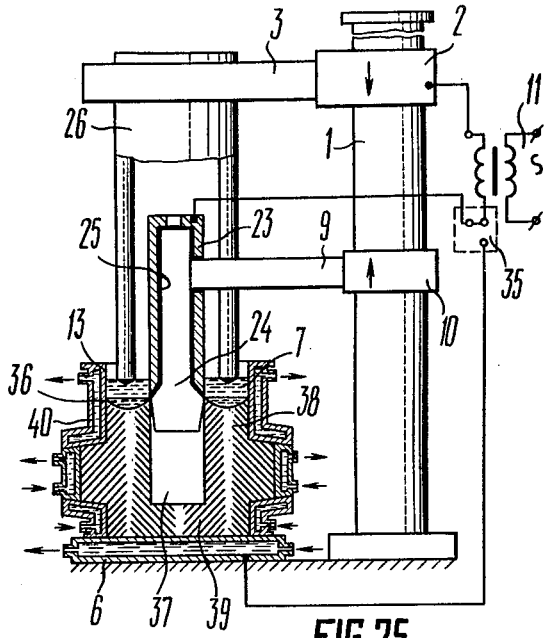
FIG. 25 shows relative position of the parts of a plant for electroslag remelting of metals and alloys at the end of the process of manufacturing a hollow shaped casting with a bottom in its lower portion.

FIGS. 24 and 25 show relative position of the plant parts at the beginning and at the end of the electroslag remelting process when producing a hollow shaped casting 38 with a bottom 39 in its lower portion.

Projecting parts of the shaped casting 38, made as bosses (of the branch pipe, flange or some other type), do not enable the transfer of an external mould 40 during the melting process; therefore upon producing the bottom 39 of a given thickness, that is effected similarly to the preceding case, and upon connecting the pole of the current supply source 11 to the non-consumable electrode 23, the mandrel 24 with said non-consumable electrode 23 is carried upwards at a rate equal to that of the slag bath 7, the mould 40 being stationary. At the end of the process, upon ascertaining the exact instant the forming shrink hole regulation must be started, and upon disconnecting the current supply source 11, the rate of withdrawal of the mandrel 24 is increased so as to provide its free removal without being jammed by the forces arising on the side of the casting 38 during its shrinkage.

Thus, said method can be successfully employed for producing various shaped castings, such as the bodies of power fittings and gates, reactor vessels for atomic power stations, etc.

Figure 26:
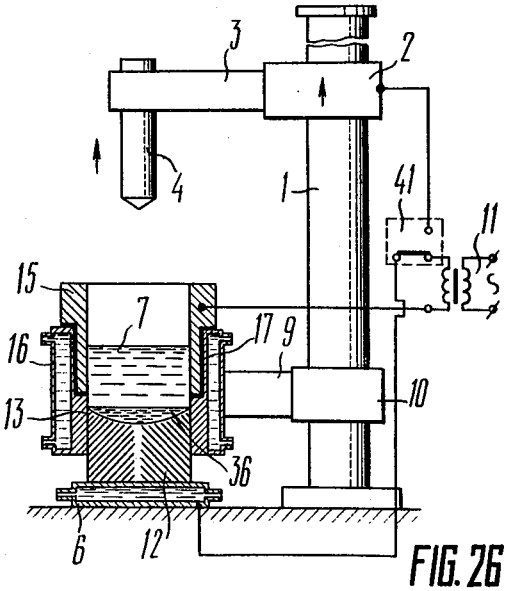
FIG. 26 depicts a plant for electroslag remelting of metals and alloys at the moment of replacement of a consumable electrode.

Considered hereinbelow is the operation of a plant with the consumable electrode 4 being replaced during melting (FIG. 26).

In contrast to the above plant a current switch 41 is connected from one side to one of the poles of the current supply source 11 and from the other side to the consumable electrode 4 or the base plate 6.

Electroslag remelting of the consumable electrode 4 is effected similarly to the above-outlined procedure, until said electrode melts. Next the current supply source 11 is disconnected from the consumable electrode 4 and connected to the base plate 6. In this case the electric current passing through the non-consumable electrode 15, the slag bath 7, the ingot 12 and the base plate 6 maintains the slag bath 7 and the metal pool 36 in hot fluid state.

At this time the consumable electrode 4 is replaced, with the end of a new consumable electrode being introduced into the slag bath 7. After that the new consumable electrode 4 is connected to the current supply source 11 by the switch 41 and electroslag remelting of said new consumable electrode 4 continues.

Evidently, said replacement of consumable electrodes can be effected as many times as required, enabling the production of heavy ingots 12 by remelting small electrodes 4.

Hence, when replacing the electrode 4, the metal pool 36 is maintained in hot fluid state which ensures a homogeneous ingot structure and a high-quality surface. The plant is convenient in service, does not require additional devices and gears, is noted for its low height and a comparatively low power input when producing ingots of various weight.

Figure 27:
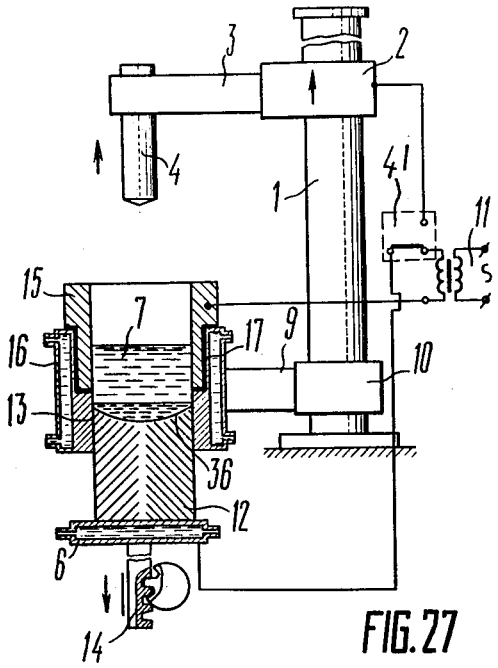
FIG. 27 shows relative position of plant parts upon melting several low-height consumable electrodes with a descending ingot.

FIG. 27 shows the operation of said plant fitted with the gear 14 for vertical transfer of the ingot 12 at the instant of fitting the next consumable electrode 4.

It is obvious that in all the above-outlined cases the proposed plant can operate by replacing the consumable electrodes in the course of melting and these cases will not be considered in detail.

To summarize considered hereinbelow will be the functioning of an electroslag remelting plant when producing shaped castings with concurrent fusing of a member which can be made of rolled products, forgings or prefabricated by the electroslag remelting technique.

Figure 28:
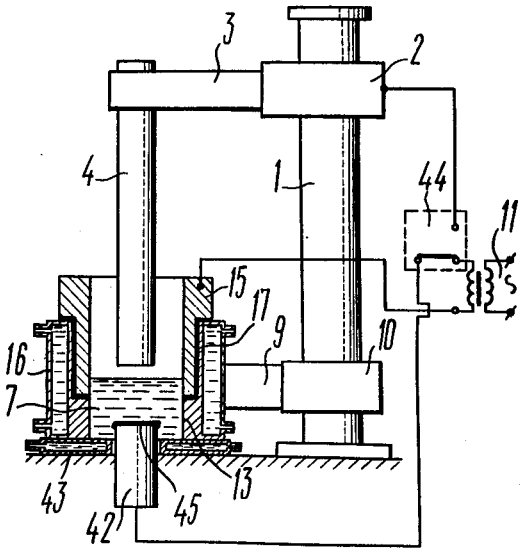
FIG. 28 shows relative position of plant parts at the beginning of the electroslag remelting process with concurrent fusing of a member.

Relative position of the plant parts at the beginning of electroslag remelting with concurrent joining of a fused member 42 is shown in FIG. 28.

A base plate 43 has an opening into which the member 42 to be fused is introduced before the process is initiated. The plant is fitted with a current switch 44 connected from one side to one of the poles of the current supply source 11 and from the other side to the fused member 42 or to the consumable electrode 4.

The plant operates in the following manner.

Figure 29:
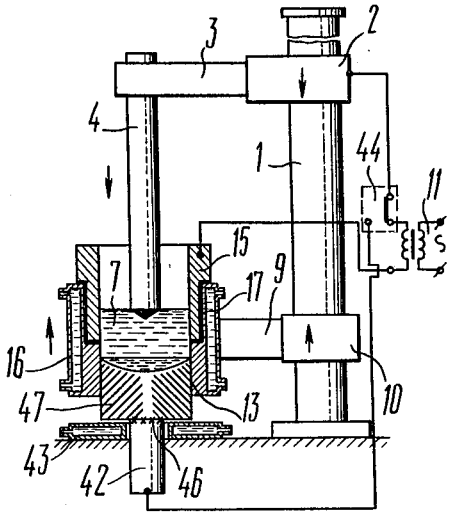
FIG. 29 shows relative position of the plant parts upon fusing said member.

Upon establishing the slag bath 7 (molten slag starting), the switch 44 connects one pole of the current supply source 11 to the fused member 42. Hence, an electric current is passed through the non-consumable electrode 15, the slag bath 7 and the fused member 42 until its top end face 45 fuses, with the consumable electrode 4 being withdrawn from the slag bath 7. Then the end of the consumable electrode 4 is submerged in the slag bath 7 and the pole of the current supply source 11 is disconnected by the switch 44 from the fused member 42 and connected to the consumable electrode 4. Thus, the electroslag remelting of the consumable electrode 4 (FIG. 29) is carried out by passing the electric current through said consumable electrode 4, the slag bath 7 and the non-consumable electrode 15.

Preliminary fusing of the top end face 45 of the fused member 42 ensures a guaranteed high-quality joint 46 between the fused member 42 and a casting body 47.

Said method is particularly useful for producing shaped combination castings with various cross section, such as, cold rolls, covers for power fitting bodies, etc., and for fusing finished members of an article to one of its parts in the course of electroslag remelting, obviating thereby welding, cutting down ultimately the production cost and ensuring high quality of the finished product.

Figure 30:
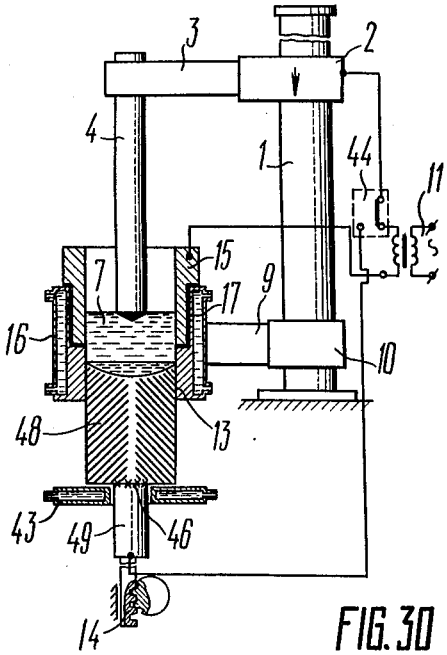
FIG. 30 shows relative position of the plant parts upon fusing said member and remelting a plurality of consumable electrodes with a descending ingot.

FIG. 30 shows another possible embodiment of a plant when producing a cold roll 48 by fusing in the course of electroslag remelting its neck 49 which may be made by rolling, by remelting a plurality of the electrodes 4 one after another and carrying the base plate 43 downwards by the vertical transfer gear 14.

It stands to reason that the present invention is not limited to the disclosed particular embodiments which must be considered by way of illustrations only. Particularly such are all the devices which constitute technical equivalents of said devices disclosed hereinbefore, as well as their combinations, in case they are made without departing from the spirit and scope of the invention as set forth in the appended claims.

What we claim is:

1. A plant for electroslag remelting of metals and alloys comprising: a bearing mast; a vertical transfer gear being secured on the bearing mast; an electrode holder mounted on the vertical transfer gear and adapted to hold a consumable electrode; a cooled base plate; a cooled mould mounted on the cooled base plate and adapted to contain a slag bath; at least one non-consumable electrode electrically non-associated with the cooled mould; an electric current supply source having different poles, one pole being connected to the electrode holder and the other pole being connected to the non-consumable electrode; and means for providing relative movement between the non-consumable electrode and the cooled base plate in a vertical direction.

2. The plant for electroslag remelting of metals and alloys of claim 1, wherein the means for providing relative movement between the non-consumable electrode and the base plate in a vertical direction comprises a vertical transfer gear mounted on the bearing mast and secured to the non-consumable electrode.

3. The plant for electroslag remelting of metals and alloys of claim 1, wherein the means for providing relative movement between the non-consumable electrode and the base plate in a vertical direction comprises a vertical transfer gear secured to the base plate.

4. A plant for electroslag remelting of metals and alloys comprising: a bearing mast; a vertical transfer gear being secured on the bearing mast; an electrode holder mounted on the vertical transfer gear and adapted to hold a consumable electrode; a cooled base plate; a cooled mould mounted on the cooled base plate and adapted to contain a slag bath; at least one hollow non-consumable electrode fixed on the internal wall of the cooled mould and electrically insulated therefrom, the non-conumable electrode encompassing the consumable electrode; an electric current supply source having different poles, one pole being connected to the electrode holder and the other pole being connected to the non-consumable electrode; and means for providing relative movement between the non-consumable electrode and the cooled base plate in a vertical direction.

5. The plant for electroslag remelting of metals and alloys of claim 4, wherein the means for providing relative movement between the non-consumable electrode and the base plate in a vertical direction comprises a vertical transfer gear mounted on the bearing mast and secured to the mould.

6. The plant for electroslag remelting of metals and alloys of claim 4, wherein the means for providing relative movement between the non-consumable electrode and the base plate in a vertical direction comprises a vertical transfer gear secured to the base plate.

7. The plant for electroslag remelting of metals and alloys of claim 4, wherein the hollow non-consumable electrode comprises current-carrying plates.

8. The plant for electroslag remelting of metals and alloys of claim 7, wherein the current-carrying plates are arranged along the entire perimeter of the internal wall of the mould.

9. A plant for electroslag remelting of metals and alloys comprising: a bearing mast; a vertical transfer gear being secured on the bearing mast; an electrode holder mounted on the vertical transfer gear and adapted to hold a hollow consumable electrode; a cooled base plate; a cooled mould mounted on the cooled base plate and adapted to contain a slag bath; at least one non-consumable electrode comprising two hollow rods concentric with each other and positioned so as to permit the hollow consumable electrode to be present therebetween; a mandrel fixed inside one of the hollow rods and elctrically insulated therefrom, the other hollow rod being fixed on the internal wall of the cooled mould and electrically insulated therefrom; an electric current supply source having different poles, one pole being connected to the electrode holder and the other pole being connected to the non-consumable electrode; and means for providing relative movement between the non-consumable electrode and the cooled base plate in a vertical direction.

10. The plant for electroslag remelting of metals and alloys of claim 9, wherein the means for providing relative movement between the non-consumable electrode and the base plate in a vertical direction comprises a vertical transfer gear mounted on the bearing mast and secured to the mould.

11. The plant for electroslag remelting of metals and alloys of claim 9, wherein the means for providing relative movement between the non-consumable electrode and the base plate in a vertical direction comprises a vertical transfer gear secured to the base plate.

12. The plant for electroslag remelting of metals and alloys of claim 1, further comprising: an opening provided in the base plate for the introduction of a member to be fused; and a current switch connected from one side to one of the poles of the electric current supply source and from the other side to the member to be fused.

13. The plant for electroslag remelting of metals and alloys of claim 1, further comprising: an opening provided in the base plate for the introduction of a member to be fused; and a current switch connected from one side to one of the poles of the electric current supply source and from the other side to the consumable electrode.

14. A plant for electroslag remelting of metals and alloys comprising: a bearing mast; a vertical transfer gear being secured on the bearing mast; an electrode holder mounted on the vertical transfer gear and adapted to hold a consumable electrode; a cooled base plate; a cooled mould mounted on the cooled base plate and adated to contain a slag bath; at least one non-consumable electrode electrically non-associated with the cooled mould; an electric current supply source having different poles, one pole being connected to the electrode holder and the other pole being connected to the non-consumable electrode; a current switch connected from one side to one of the poles of the electric current supply source and from the other side to the base plate; and means for providing relative movement between the non-consumable electrode and the cooled base plate in a vertical direction.

15. A plant for electroslag remelting of metals and alloys comprising: a bearing mast; a vertical transfer gear being secured on the bearing mast; an electrode holder mounted on the vertical transfer gear and adapted to hold a consumable electrode; a cooled base plate; a cooled mould mounted on the cooled base plate and adapted to contain a slag bath; at least one non-consumable electrode electrically non-associated with the cooled mould; an electric current supply source having different poles, one pole being connected to the electrode holder and the other pole being connected to the non-consumable electrode; a current switch connected from one side to one of the poles of the electric current supply source and from the other side to the electrode holder; and means for providing relative movement between the non-consumable electrode and the cooled base plate in a vertical direction.

16. The plant for electroslag remelting of metals and alloys of claim 1, wherein the non-consumable electrode is made of graphite.

17. A method of electroslag remelting of metals and alloys in a plant comprising: a bearing mast; a vertical transfer gear secured on the bearing mast; an electrode holder mounted on the vertical transfer gear and adapted to hold a consumable electrode; a cooled base plate; a cooled mould mounted on the cooled base plate and adapted to contain a slag bath; at least one non-consumable electrode electrically non-associated with the cooled mould; an electric current supply source having different poles, one pole being connected to the electrode holder and the other pole being connected to the non-consumable electrode; and means for providing relative movement between the non-consumable electrode and the cooled base plate in a vertical direction; the method comprising the steps of: establishing a slag bath in a mould cavity defined by the cooled mould and the cooled base plate; immersing one end of a consumable electrode and one end of the non-consumable electrode in the slag bath; and remelting the consumable electrode by connecting the consumable electrode and the non-consumable electrode to the different poles of the electric current supply source and passing an electric current through a circuit consisting of the consumable electrode, the slag bath and the non-consumable electrode.

18. The method of electroslag remelting of metals and alloys of claim 17, further comprising, during the remelting of the consumable electrode, the steps of: transferring the non-consumable electrode upwards at a rate equal to the rate of movement of the slag bath to maintain the end of the non-consumable electrode immersed in the slag bath; and transferring the consumable electrode downwards into the slag bath as the consumable electrode is remelted.

19. The method of electroslag remelting of metals and alloys of claim 17, further comprising, during the remelting of the consumable electrode, transferring the base plate downwards to remove an ingot formed by the remelted consumable electrode and to maintain the level of the slag bath constant with respect to the non-consumable electrode and the mould which are stationary.

20. The method of electroslag remelting of metals and alloys of claim 17, further comprising, during the remelting of the consumable electrode, transferring the non-consumable electrode together with the mould upwards with respect to an ingot formed by the remelted consumable electrode.

21. The method of electroslag remelting of metals and alloys of claim 17, wherein the non-consumable electrode is hollow and further comprising the steps of: fixing the hollow non-consumable electrode on the internal wall of the mould; and, during the remelting of the consumable electrode, transferring the base plate downwards to remove an ingot formed by the remelted consumable electrode, with the mould and the non-consumable electrode being stationary.

22. The method of electroslat remelting of metals and alloys of claim 17, further comprising, during the remelting of the consumable electrode, the steps of: transferring the consumable electrode upwards at a rate of 0.05–0.95 the rate of movement of the slag bath; and transferring the non-consumable electrode and the mould upwards at a rate equal to the rate of movement of the slag bath to maintain the end of the consumable electrode and the end of the non-consumable electrode immersed in the slag bath.

23. The method of electroslag remelting of metals and alloys of claim 17, wherein the non-consumable electrode is hollow and further comprising, during the remelting of the consumable electrode, the steps of: transferring the base plate downwards to remove an ingot formed by the remelted consumable electrode and to maintain the level of the slag bath constant with respect to the non-consumable electrode and the mould which are stationary: and transferring the consumable electrode downwards into the slag bath as the consumable electrode is remelted.

* * * * *